United States Patent [19]

Siemer

[11] Patent Number: 4,709,379

[45] Date of Patent: Nov. 24, 1987

[54] TAPED PARTS COUNTER

[76] Inventor: Dennis K. Siemer, R.R. 5, Box 122C, Mankato, Minn. 56001

[21] Appl. No.: 928,029

[22] Filed: Nov. 7, 1986

[51] Int. Cl.[4] ..... G06M 7/00

[52] U.S. Cl. ..... 377/3; 377/24; 377/53

[58] Field of Search ..... 377/3, 18, 24, 53, 6

[56] References Cited

U.S. PATENT DOCUMENTS

| | | | |
|---|---|---|---|
| 2,685,082 | 7/1954 | Beman et al. | 377/3 |
| 3,843,871 | 10/1974 | Fujimaki et al. | 377/3 |
| 3,941,981 | 3/1976 | Abe et al. | 377/53 |
| 4,031,360 | 6/1977 | Soule | 377/24 |
| 4,150,282 | 4/1979 | Aoki et al. | 377/53 |
| 4,166,246 | 8/1979 | Matt | 377/53 |
| 4,181,960 | 1/1980 | Tateishi et al. | 377/53 |
| 4,280,159 | 7/1981 | Nakayama | 377/24 |
| 4,317,989 | 3/1982 | Sargent | 377/24 |
| 4,457,008 | 6/1984 | Nakatani et al. | 377/18 |

*Primary Examiner*—John S. Heyman

*Attorney, Agent, or Firm*—Oppenheimer Wolff & Donnelly

[57] ABSTRACT

A taped parts counter which includes a photosensor system for counting the number of small parts encapsulated and carried by a storage tape. The small parts are contained in the storage tape at pre-determined and equal intervals. The intervals have a space relationship to drive holes in the edge of a storage tape. Movement of the storage tape past a sprocket drives a radiation interrupter wheel on which fins interrupt a radiation source in direct relationship to the parts moving past the sprocket. An electrical signal is generated by a photosensitive device as radiation from the radiation source strikes the photosensitive device. The electrical signals are counted by an electrical counting circuit.

8 Claims, 10 Drawing Figures

TAPED PARTS COUNTER

FIELD OF THE INVENTION

The invention is directed to apparatus for taking an inventory or keeping a running inventory of tiny parts stored on a storage tape. The counting apparatus can be used for taking inventory of a multitude of small components or as input to a manufacturing apparatus to monitor the remaining inventory on a supply line of a continuous manufacturing system.

BACKGROUND OF THE INVENTION

Businesses engaged in manufacture are constantly presented with the need to determine the inventory of parts currently available for production of complicated machinery and electrical apparatus. Miniaturization of electrical circuits and parts in the electronics and electrical-mechanical arts has evolved to the point where many of the parts used in devices such as miniature calculators, computers, watches and similar devices using computer memory storage chips, diodes, and similar elements are difficult to store and handle when the parts are in inventory or are being used in conjunction with a mass production line utilizing a large supply of the components.

Many of these electrical parts, as an example, are so tiny that they are stored on tapes which are then rolled onto supply reels for handling. The microchip or other small parts are encapsulated on the surface of a storage tape by providing a cavity on the storage tape over which another tape is placed in order to encapsulate or capture the tiny part and protect the parts from damage or destruction.

Many of these parts are individually very tiny but also quite valuable. Consequently, a manufacturer must, for tax reasons and future production reasons, keep a running account of the number of such parts in inventory. The physical problem of handling the total number of such tiny parts is extremely difficult from a bulk handling point of view. Consequently, the encapsulating storage tapes become a useful method for maintaining these parts in inventory. The tapes protect the parts, provide a supply roll of sufficient size for handling by employees. On the other hand, such storage complicates the problem of counting the parts for the purpose of identifying a total number of such parts in inventory. Further, the small size of these parts becomes a burden when the parts are placed on a manufacturing line where they are used at a rapid pace. Control of the parts in a way that protects the parts from damage or destruction is essential. Also, it is imperative that during the process of manufacturing, that the assembly operation maintain a running inventory of parts available to the manufacturing process at all times. Many electronic units contain literally thousands of tiny parts for inclusion in a single finished electrical unit. If even one of these parts is exhausted during the manufacturing process, then the entire manufacturing line will be shut down. Consequently, a manufacturer is burdened with the problem of keeping a "running inventory" of the number of parts available during the continuous manufacturing of larger electrical units.

A variety of methods have been used to keep track of the storage inventory and the manufacturing inventory of small parts. Some inventory systems rely on weight as a way of measuring the total number of small items in inventory. Each unit has a known weight which can be used to calculate the number of units from a total weight of a bulk container of such small units. The disadvantage of this weight determination system is that very expensive electronic scales must be used to make the weight checks. These electronic scales are subject to variations in the weights measured and therefore must be constantly recalibrated. Further, weight counting systems are not particularly useful and efficient in a continuous manufacturing process since some of these systems have been subject to variations due to heat, dust conditions and similar environmental conditions which would tend to give erroneous weight calculations and therefore give erroneous calculations as to the number of tiny parts in inventory.

In other operations, tiny parts are stored in packages of a finite number per package. For instance, tiny resistors might be stored in packages of fifty units per styrofoam package. These storage units are adequate for the purpose of storing the tiny components but this storage system is difficult to integrate into a continuous manufacturing system with an attendant continuous counting system designed to alert operators of continuous manufacturing processes of the current status of inventory supply to the manufacturing line.

The present invention is designed to provide an inexpensive and accurate apparatus for counting tiny parts stored on a storage tape. The apparatus can be used to count parts encapsulated on a tape which are merely held in inventory or it can be utilized to determine the remaining number of components on a particular storage tape being used on a manufacturing line.

INFORMATION DISCLOSURE STATEMENT

The following patents which are believed to be pertinent to the subject matter of this invention are presented in compliance with the inventors duty to disclose all materials of which he is aware.

The Toulmin, Jr. Patent (U.S. Pat. No. 2,888,570) shows the concept of reading areas on the upper surface of a tape which moves between a take-up reel and a supply reel and past a radiation source.

The Bellamy Patent (U.S. Pat. No. 2,968,793) discloses a method for processing data or information also carried on a tape. A series of optical pick-ups identify various information from the tape moving past the optical systems. This information is then recorded and used in information storage systems.

The Schooley Patent (U.S. Pat. No. 3,234,360) discloses a photosensitive system for counting strips on a moving fabric. The counting system is used in the manufacture of textiles to indicate the count per linear inch of threads in fabrics.

Malina Patent (U.S. Pat. No. 3,526,890) discloses a linear tape transducer used in connection with the machine tool business.

The Bracken Patent (U.S. Pat. No. 3,718,807) discloses a method and apparatus for packaging and pricing photographic prints. The apparatus is used in connection with the cutting and packaging of negative film strips in appropriate length, cutting the prints, counting the prints and calculating the appropriate price for the services.

The Strandberg Patent (U.S. Pat. No. 3,721,809) discloses an apparatus for counting threads in a moving fabric by utilizing radiation for direct penetration through the fabric. A fabric length measuring transducer is provided to measure the fabric while the threads are being counted and to produce a length count related to the pulses which are picked up by an appropriate sensing device.

Maggi Patent (U.S. Pat. No. 3,793,508) discloses another film frame counter utilizing an optical scanner.

Abe, et al Patent (U.S. Pat. No. 3,941,981) discloses a counter for retrieving information stored on a roll of film. This counter is again used in the photographic film industry and identifies information from the film moving by an appropriate sensor.

Sargent Patent (U.S. Pat. No. 4,317,989) discloses an apparatus and method for measuring the length of sheets of paper. The apparatus using a running web which carries a mark which is identified by adjacent apparatus and converted to a pulse. These pulses are then counted in the measuring process.

Caldwell Patent (U.S. Pat. No. 4,551,847) discloses a hand held digital measuring device. This device is the equivalent of a ruler, yardstick or tape measure.

BRIEF DESCRIPTION OF THE INVENTION

Accordingly, a principal object of the invention is to provide an improved apparatus for counting small parts carried on a storage tape.

Another object of the invention is to provide an inexpensive apparatus for counting small parts encapsulated and stored on a storage tape.

A further object of the present invention is to provide a new and improved apparatus for rapidly making an inventory count of small parts or components encapsulated on a storage tape where the tape can be rapidly moved by a counter to make a count of the small parts or components.

A still further object of the present invention is to provide a new and improved small parts counting apparatus for keeping a running inventory count of small parts carried by a storage tape in a continuous manufacturing assembly line.

Yet another object of the present invention is to provide an apparatus for using a photosensitive electrical system for counting small parts encapsulated on a storage tape while the tape is rapidly moved by the photosensitive device.

Yet another object of the present invention is to provide an apparatus using a radiation sensor for counting small components encapsulated on a storage tape as the storage tape moves by a sprocket which is activated by the storage tape, where the sprocket drives an interrupter wheel which intercepts a radiation source to general signals indicating the number of small parts contained on the storage tape.

A further object of the present invention is to provide a new and improved apparatus using a diode emitter and a transistor electrical sensors for counting small parts encapsulated on a storage tape.

More broadly stated, one of the aspects of the invention is used in a system employing a moving storage tape with perforations on at least one edge of the tape which is moved by a sprocket that engages the perforations on the edge of the tape to rotate a radiation interrupter. Small parts encapsulated on the storage tape are spaced in direct relationship to the perforations on the edge of the storage tape so that the number of components on the storage tape corresponds to the perforations in the storage tape. Rotation of the sprocket by the moving storage tape activates a radiation interrupter which has interruption fins about the periphery of a wheel. The fins are positioned in relation to the number of sprocket pins on the sprocket and therefore the fins indirectly correspond to the number of parts incapsulated on the tape. Interruptions of a radiation source by the fins on the radiation interrupter produces electrical signals in a radiation sensor which then act as a count of the number of components carried by the storage tape. Other aspects of the invention, will become more apparent with reference to the drawings and the detailed description of the invention which follows.

DETAILED DESCRIPTION OF THE INVENTION

Figure 1:
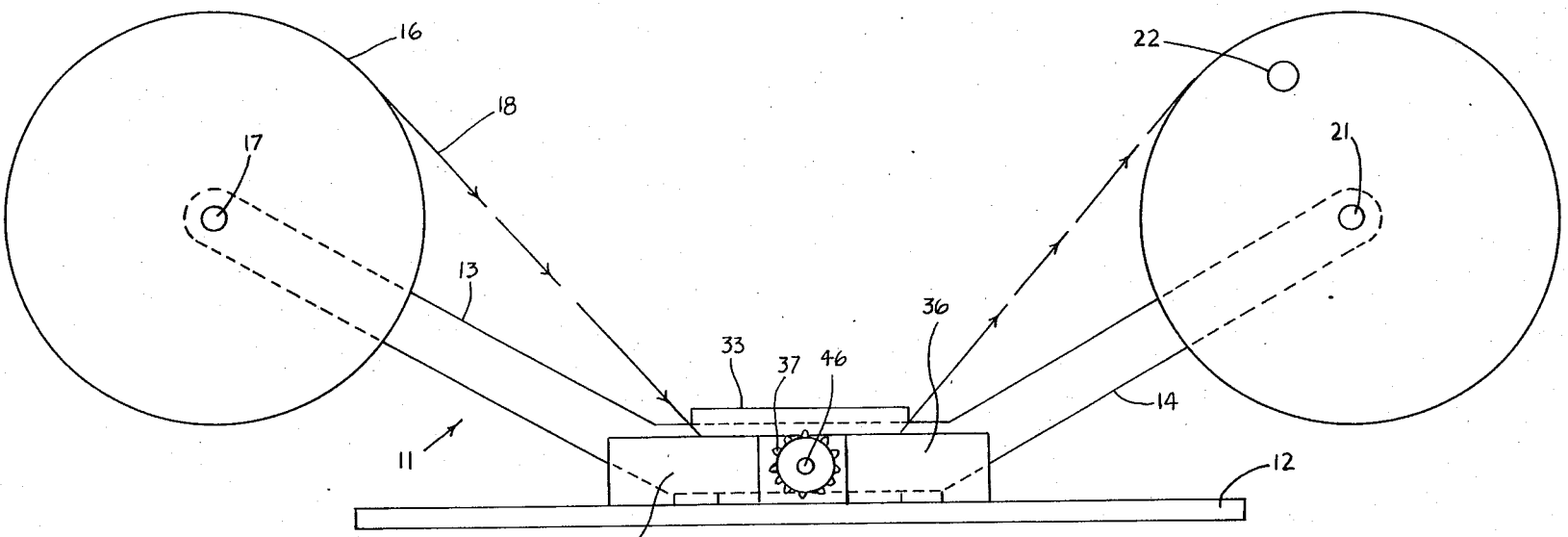
FIG. 1 is a front view of the apparatus.

Refer now to FIG. 1 of the drawings where the invention is illustrated in the front view. For illustrative purposes, the invention will be described as it is employed for the purpose of counting the inventory of small parts or components carried on a stage tape for inventory purposes. It should be understood, however, that this same device with only slight modification can be connected to a power source and to a manufacturing assembly line and act as the supply source for small components being incorporated into larger mechanical and electrial units. This will become more apparent from the following further detailed description.

The apparatus has a frame generally designated by numeral 11. Frame 11 includes a base 12 on which is mounted extensions 13 and 14. Extensions 13 and 14 can be bolted to the base 12, welded to the base 12 or otherwise attached in a rigid fashion. The method of attaching extensions 13 and 14 to the base 12 is not important except that the attachment should provide a rigid frame 11 for the purpose of carrying other elements of the invention.

Figure 4:
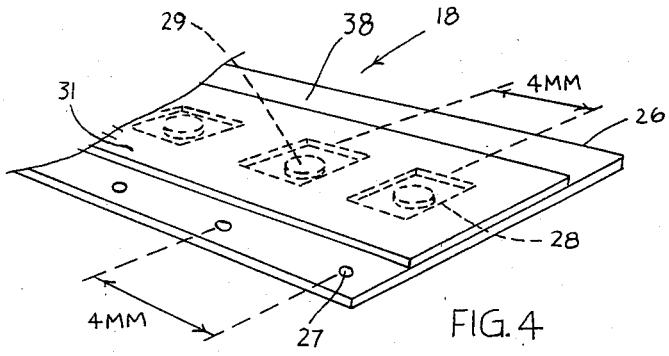
FIG. 4 is a fractional view in perspective of a storage tape.

A supply reel 16 is mounted on a shaft 17 which in turn is attached to extension 13 of frame 11. Supply reel 16 is designed to carry a quantity of storage tape 18. Refer to FIG. 4 of the drawings for a specific pictorial perspective view of the storage tape which will be described in detail later.

A take-up reel 19 is mounted on extension 14 of frame 11. Take-up reel 19 can be mounted on extension 14 in the same way that the supply reel 16 is mounted on extension 13. In one version, shaft 21 is rigidly mounted on extension 14 and take-up reel 19 merely rotates on a bearing arrangement on shaft 21. This arrangement could be used where take-up reel 19 is hand operated with an operator grasping a handle 22 to draw the storage tape 18 from supply reel 16.

Figure 2:
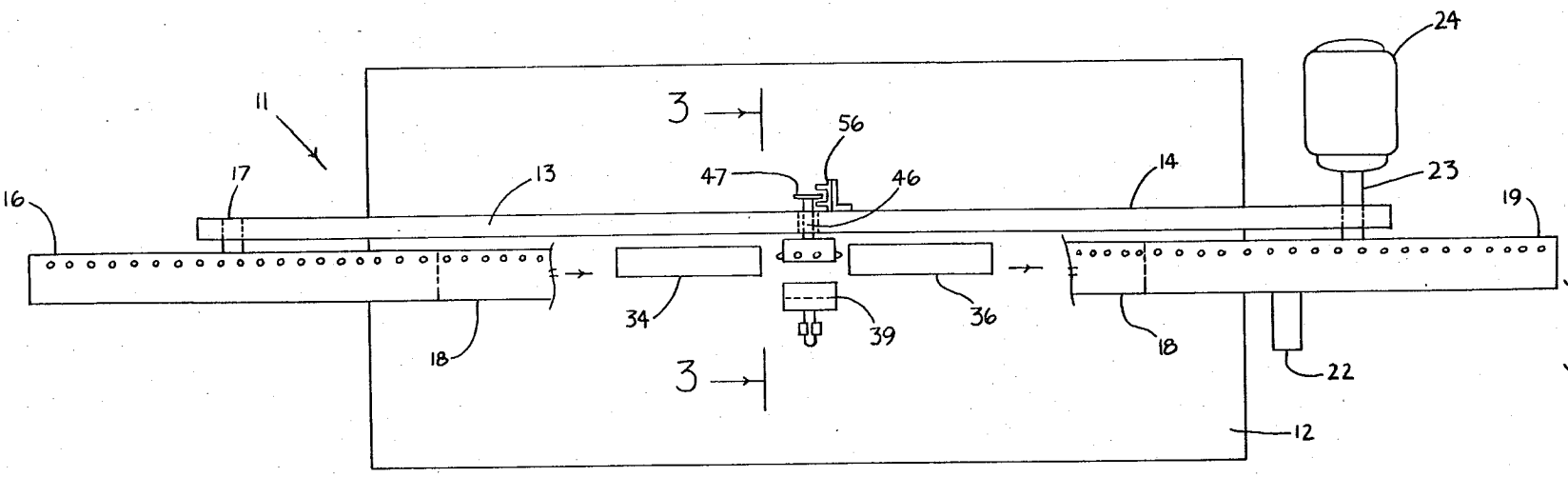
FIG. 2 is a top plan view of the apparatus.

In another version of the invention, the take-up reel 19 can be mounted on a power driven shaft 23 which is depicted in FIG. 2 of the drawings. In this version, an electrical motor 24 drives shaft 23 and the attached take-up reel 19 to draw storage tape 18 from supply reel 16. A power driven system would be used where the apparatus forms a part of a manufacturing line and the apparatus is acting as a continuous supply counter providing a running inventory of supply parts available to the manufacturing assembly process. The hand operated version of the apparatus would be used for simple inventory determination methods where supply reels of the tape might be taken out of inventory and connected to the apparatus for the purpose of simply counting the number of components on the storage tape. This will become more apparent with further description of the drawings.

Refer now to FIG. 4 of the drawings which illustrates the storage tape 18. One version of the storage tape 18 would include a base web 26 which has drive holes 27 on at least one edge of the web 26. These holes 27 in a standard configuration are placed at 4 millimeter spaced interviews along the edge of the web 26. Depressions 28 are placed in the base web 26 into which small parts or components 29 are stored or carried. The parts 29 are then encapsulated on the storage tape 18 by placement of an encapsulating tape 31 over the depressions 28 and thereby capturing the components 29 in depressions 28.

Depressions 28 are located along storage tape 18 at 4 millimeter intervals which are equal to the spacing intervals of drive holes 27. In this way, there is one hole 27 for each encapsulated component 29 carried by the storage tape 18.

Other variations of this storage tape 18 are possible. For instance, instead of using an encapsulating tape 31, the components 29 may simply be adhesively attached to the base web 26. Other encapsulation systems may be used and will be successful depending upon the application and the use of the storage tape 18. If the storage tape 18 is to be used in a continuous manufacturing process in addition to its function as a storage device for micro parts, then there must be an easy and continuous method for gaining access to the components 29 so that the components can be removed from the encapsulation to assembly into a larger mechanical or electrical device.

Further, the number of encapsulated components 29 on the tape may be varied depending upon the size of the component. For instance, if the 4 millimeter space interval between components is inadequate because of the size of the components 29, then the length of the interval between components 29 can be varied in multiples of 4 millimeters. As an example, a larger component could be accommodated and counted by the use of the storage tape 18 by placing one component for each 8 millimeters of space on the tape. Another choice would be to place components 29 at 12 millimeter space intervals. It will be readily observed, that in these two examples the components 29 are spaced at distances which are even multiples, 2 and 3, of the 4 millimeter distance between holes 27 on storage tape 18. This direct relationship between the spacing of the components 29 and the spacing of the holes 27 permits the use of a photosensitive counting system associated with the apparatus for the purpose of rapidly counting the number of components carried by storage tape 18. This relationship will become more apparent from a further detailed description of the operation of a photosensitive measuring device hereafter.

Figure 3:
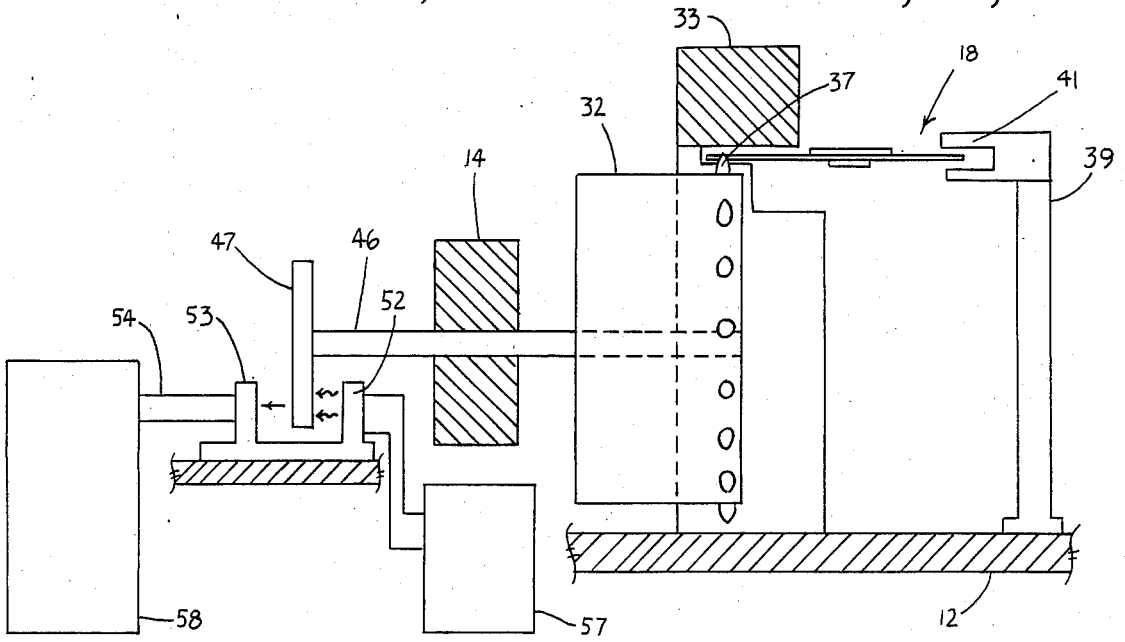
FIG. 3 is a partial cross-sectional view with blocked diagrams for counter circuitry taken along line 3—3 of FIG. 2.

In operation, supply reel 16 is placed on shaft 17 and tape 18 is fed from supply reel 16 and into contact with sprocket 32. Supply tape 18 is held into contact with sprocket 32 by a top tape guide 33 which is mounted on top of bottom guides 34 and 36. Bottom guides 34 and 36 are attached to base 12. Bottom guides 34 and 36 are positioned on based 12 adjacent extensions 13 and 14 as further illustrated in FIG. 2 of the drawings. In the preferred embodiment of the invention, sprocket 32 is positioned as noted in FIG. 2 between two bottom guides 34 and 36. The bottom guides 34 and 36 and the sprocket 32 are positioned so that the drive holes 27 of supply tape 18 engage pins 37 of sprocket 32. This relationship can be observed more clearly in FIG. 3 of the drawings where tape 18 is shown engaging pins 37 of sprocket 32. The tape 18 are guided into contact with pins 37 by top tape guide 33 and bottom tape guide 34. FIG. 3 is viewed along lines 33 of FIG. 2 for reference purposes. The unperforated edge 38 of the supply tape 18 is guided by tape edge guide 39 which is positioned opposite sprocket 32 as viewed in FIGS. 2 and 3. Tape edge guide 39 is mounted on base 12 so that it can be adjusted in the lateral direction as viewed in FIG. 3 to accommodate a supply tape 18 of different sizes. The tape edge guide 39 captures unperforated edge 38 between fingers 41 and 42 to insure that storage tape 18 does not move laterally while it is being fed from supply reel 16 to take-up reel 19.

Figure 7:
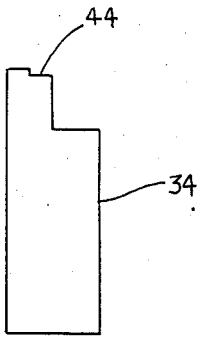
FIG. 7 is an end view of a bottom tape guide viewed along line 7—7 of FIG. 6.

The perforated edge of tape 18 engages sprocket 32 which contains pins 37. These pins 37 are spaced at intervals equal to the distance between holes 27 on the edge of supply tape 18. The spacing between holes 27 and between pins 37 on the sprocket 32 are as previously indicated, 4 millimeters in a preferred embodiment of the invention. Sprocket 32 is vertically positioned as viewed in FIG. 3 of the drawings so that the pins 37 engage holes 27 in the slot 43 formed between to guide 33 and bottom guide 34. An enlarged end view of bottom guide 34 is illustrated in FIG. 7. In that figure, it is noted that surface 44 is the surface which guides the tape into contact with pins 37. Top tape guide 33 captures the perforated edge of the storage tape 18 when it is mounted on top of bottom guide 34 as illustrated in FIG. 3 of the drawings.

When supply tape 18 is thus captured between top guide 33 and bottom guide 34 and 36, the holes 27 engage pins 37 and rotate sprocket 32 as tape 18 is drawn past sprocket 32 and onto take-up reel 19. In the case of a simple inventory counting apparatus, the take-up reel 19 may be operated by hand using a handle 22 as illustrated in FIG. 1 of the drawings. Again, as illustrated in FIG. 2, if the apparatus is to be used in a manufacturing process, then take-up reel 19 can be operated by an electric motor 24 or some other suitable power means to draw storage tape 18 from supply reel 16, past drum 32 and onto take-up reel 19 in the arrow direction in FIG. 1 of the drawings.

Figure 5:
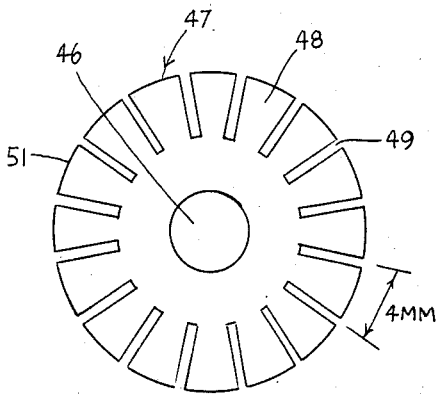
FIG. 5 is a front view of a radiation interrupter.
Figure 6:
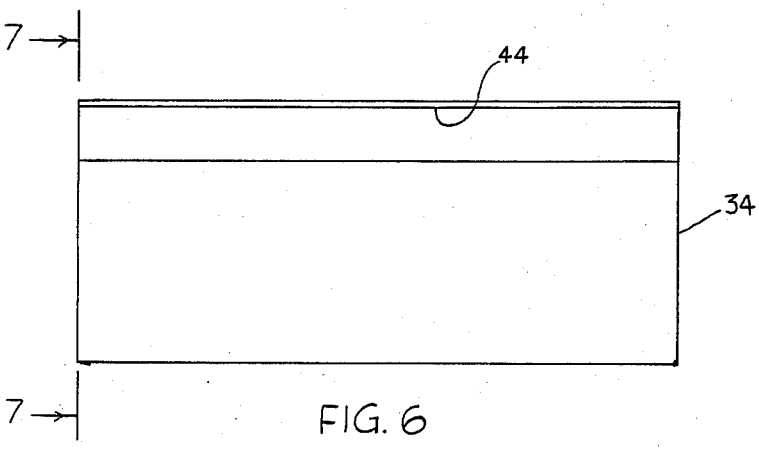
FIG. 6 is a front view of a bottom tape guide.
Figure 8:
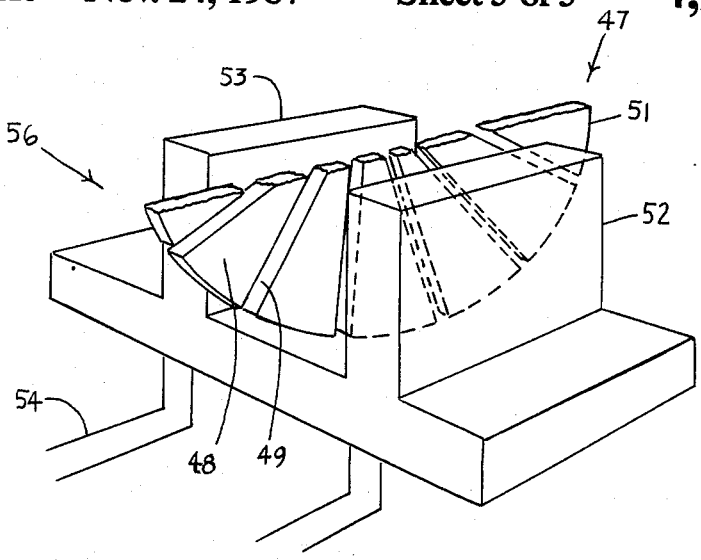
FIG. 8 is an enlarged pictorial fractional view showing a combination radiation emitter and radiation sensor with an interposed interrupter.

Sprocket 32 is mounted on shaft 46. Shaft 46 is mounted for rotation in frame 11 midway between extensions 13 and 14. This mounting is illustrated in FIG. 3 of the drawings. At the end of shaft 46 opposite sprocket 32, a radiation interrupter wheel 47 is mounted for rotation with shaft 46. This radiation interrupter wheel 47 is more completely illustrated in FIG. 5 of the drawings and also in the fractional view in FIG. 8 of the drawings. The interrupter wheel has a series of fins 48 which are separated by slots 49. The slots 49 are radial cuts extending from the periphery 51 of the wheel in a radial direction around the wheel and are spaced at predetermined intervals. The fins 48 in the simplest version of the interrupter wheel have a dimension of 4 millimeters as viewed in FIG. 5 of the drawings and corresponds to the 4 millimeter separation between pins 37 and drive holes 27 of the storage tape 18.

Figure 9:
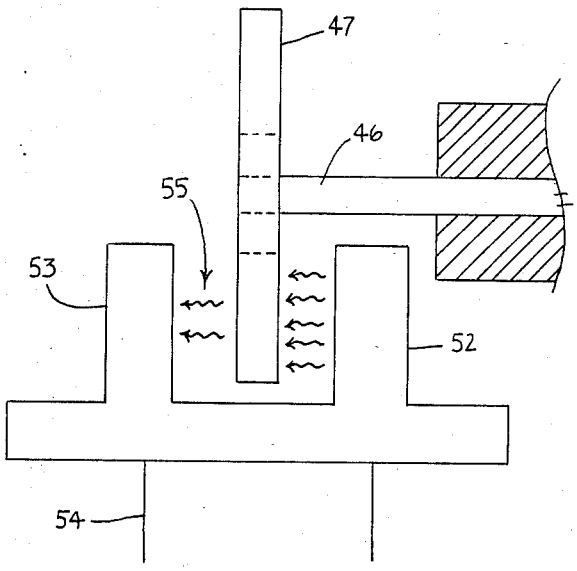
FIG. 9 is an enlarged pictorial view of an end view of a radiation emitter and radiation sensor combination with an interrupter wheel interposed between the emitter and the sensor; and, FIG. 10 is an electrical block diagram of the electrical circuitry used in the invention.

Refer now to FIGS. 3 and 9 of the drawings. Interrupter wheel 47 is positioned between a radiation emitter 52 and a photosensitive element 53. Radiation 55 generated by emitter 52 will strike photosensitive element 53 only when radiation is permitted to pass through slots 49 of interrupter wheel 47. While fins 48 are in position between the emitter 52 and the photosensitive element 53, no signal will be generated by the photosensitive element 53. Thus, it can be seen that as the interrupter wheel 47 is rotated, the successive passage of fins 48 and slots 49 between the emitter 52 and the photosensor element 53 will generate on and off signals on electrical lines 54.

Figure 10:
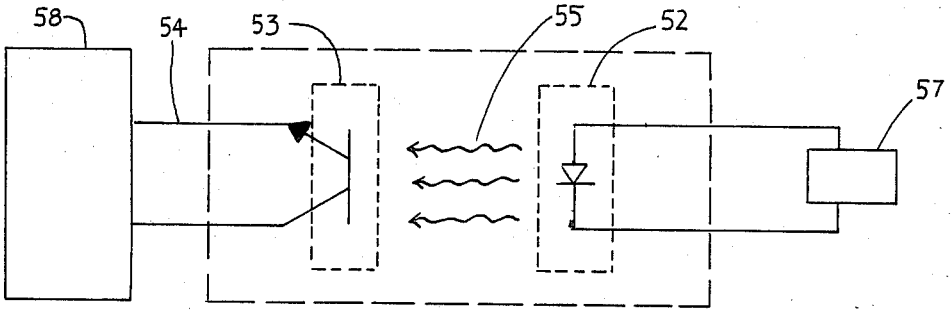

Radiation emitter 52 can be any source of radiation which can be detected by a matched sensing element 53. Likewise, the photosensitive element 53 can be any electrical device capable of generating an electrical signal in response to radiation impinging on the element 53 from emitter 52. In a preferred embodiment of the invention, the radiation emitter 52 is a gallium arsenide infrared emitting diode as illustrated in FIG. 10 of the drawing which is housed in a plastic housing opposite a silicon phototransistor 53. A plastic housing generally designated by the number 56 in FIG. 8 of the drawings demonstrates that the emitter 52 can be housed in a stable housing of plastic along with the photosensitive element 53 so that the entire unit can be mounted on frame 11 as illustrated in FIG. 3. This positioning of the housing or module 56 is also illustrated in FIG. 2 of the drawings where it is shown in the plan view mounted opposite sprocket 32 on base 11 of the apparatus.

Reference to FIG. 10, which illustrates an electrical block diagram, shows a power source 57 connected to emitter 52 to electrically power emitter 52 to generate radiation 55. When radiation 55 strikes the photosensitive element 53, a signal is generated across lines 54 and fed into counter circuit 58. Each time photosensitive element 53 generates a signal, this signal operates a standard electrical counting circuit 58 for the purpose of registering the number of times that radiation strikes the photosensitive element 53. Consequently, these electrical impulses can be used to count the number of times that wheel 47 permits radiation to pass through slots 49 for the purpose of controlling other operations. Each pulse can also be counted and tabulated to obtain a total number of pulses or the pulses can be further utilized for the purpose of controlling or signaling other electrical mechanical devices.

In the most simple illustration of the operation of the apparatus the storage tape 18 is drawn from supply reel 16 between top guide 33 and bottom guides 34 and 36 past sprocket 32 where drive holes 27 on the edge of storage tape 18 engage pins 37 mounted on sprocket 32. As the storage tape 18 is drawn past sprocket 32 by take-up reel 19, sprocket 32 is rotated. In the simplest form of this invention, a component 29 is positioned each 4 millimeters along the length of storage tape 18 which is the exact time spaced interval as drive holes 27 and the spacing between pins 37 on sprocket 32. Consequently each time hole 27 engages a pin 37, this equals a designation of one component 29.

Sprocket 32 now being driven by storage tape 18 rotates wheel 47. Slots 49 positioned along the periphery of wheel 47 are located 4 millimeters apart by fins 48. Consequently, if sprocket 32 and wheel 47 are of the same diameter, each time a hole 27 engages a pin 37, a slot 49 will become positioned between emitter 52 and photosensitive element 53 to permit radiation to pass from emitter 52 to element 53. This will then generate an electrical signal output on line 54. Consequently it will be observed that each pulse of current on line 54 generated by the photosensitive element 53 corresponds to one small component positioned or encapsulated on storage tape 18. Each of these signals is then counted by a counter circuit 58 so that a total inventory of the number of components 29 encapsulated on storage tape 18 may be tabulated by simply running the storage tape 18 passed sprocket 32 and tabulating the total number of components encapsulated on the storage tape.

As previously indicated, the encapsulated components 29 do not need to be spaced exactly 4 millimeters apart in order for the apparatus to function. The components 29 can be positioned at multiples of 4 millimeters or in multiples of the spacing between holes 27. In this instance, as an example, a component 29 might be positioned each 8 millimeters along storage tape 18. In this case, the counter circuit would be calibrated so that for each two electrical outputs on line 54, a single count will be registered by the electrical counting circuit, thus, making a count of the components positioned 8 millimeters apart on storage tape 18.

This apparatus may also be used as more than a simple inventory tabulating apparatus. It may be used in a continuous manufacturing operation. In this application, the counter circuit will be altered to instruct other computer controlled apparatus or other signaling devices that a predetermined number of components 29 are left on storage tape 18.

While the foregoing description of the preferred embodiment of the invention has been described in connection with an inventory device with a further illustration of methods of incorporating the apparatus into manufacturing processes, it will be apparent to those skilled in the art that changes can be made in this embodiment without departing from the principles and spirit of the invention. For example, a variety of different radiation detection devices might be used. Further, only minor changes need be made in the counting electrical circuitry in order to achieve different uses for the device. The device might be altered in order to package a prescribed number of components into a storage tape for sale. In such a case, a continuous storage tape might be passed by the photo sensor for the purpose of packaging a prescribed number of components per tape for sale to users. This and other embodiments of the invention which do not depart from the principles and spirit of the invention are defined in the appended claims.

What is claimed is:

1. Apparatus for counting small parts encapsulated at equal and predetermined spaced intervals along a storage tape which comprises a supply reel of storage tape having small parts encapsulated at equal intervals along said tape, said tape having a first edge and a second edge having drive holes, said drive holes being equally spaced at predetermined intervals with a separation at even multiples of the predetermined spaced intervals of said parts, an elongated frame means having a first and second extension, means for rotatably attaching said reel to the first extension of said frame means, a bottom tape guide mounted on said frame means intermediate of said first and second extensions, a shaft mounted in said frame means intermediate said first and second extension and adjacent said bottom tape guide, said shaft having a first end extending beyond said frame means adjacent said bottom tape guide and a second end extending beyond said frame means, a sprocket in the shape of a wheel attached to said first end, pins mounted about the circumference of said sprocket at intervals corresponding to the separation between the holes on said tape and adapted to engage said holes, drive means mounted on the second extension of said frame means for engaging said tape and drawing said tape off the supply reel mounted on said first extension and into contact with the said sprocket to engage the holes of said tape with the said pins to rotate the said sprocket, a top tape guide mounted on said bottom tape guide to capture the edge of said tape having holes between the top and bottom tape guides to direct the tape into alignment with said sprocket and into engagement with said pins, a radiation interrupter wheel having first and second sides attached to the second end of said shaft, said interrupter wheel having radially extending fins separated by slots, said fins being spaced about the circumference of said wheel to correspond to the spaced intervals between said pins, a radiation emitter, a photosensitive element, said emitter and photosensitive element mounted adjacent said frame and separated by said fins, said fins interrupt radiation at intervals corresponding to the spaced intervals between said pins, electrical impulse counting means connected to said photosensitive element to count electrical impulses generated by said photosensitive element from radiation emitted by said emitter passing between said fins as said wheel is rotated by said sprocket whereby said small parts along said tape are represented correspondingly by said slots and are thereby counted.

2. An apparatus in accordance with claim 1, which further includes a tape edge guide mounted on said frame for engaging said first edge of said storage tape to capture said tape between said edge and direct said tape in a straight line over the pins on the periphery of said sprocket.

3. An apparatus in accordance with claim 1 in which the holes in the second edge of said tape are spaced at intervals of 4 mm.

4. An apparatus in accordance with claim 1 in which said radiation emitter emits infrared radiation and in which said photosensitive element generates an electrical impulse in response to infrared radiation.

5. An apparatus in accordance with claim 1 in which said radiation emitter is a light emitting diode and in which said photosensitive element is a photosensitive transistor.

6. An apparatus in accordance with claim 5 in which said radiation emitter is a gallium arsenide infrared emitting diode and in which said photosensitive element is a silicon phototransistor.

7. An apparatus in accordance with claim 1 in which said drive means is a hand-operated take-up reel mounted on the second extension of said frame for engaging said tape to draw said tape off said supply reel between said top and bottom guides and into engagement with said pins on the periphery of said sprocket.

8. An apparatus in accordance with claim 1 in which said drive means includes a take-up reel to engage said tape and an electrical power means connected to said take-up reel to draw said tape off said supply reel between said top and bottom guides and into engagement with said pins on the periphery of said sprocket.

* * * * *